United States Patent [19]

Bennett et al.

[11] Patent Number: 4,873,933

[45] Date of Patent: Oct. 17, 1989

[54] FLOAT-FREE ARRANGEMENT FOR MARINE RADIO DISTRESS BEACONS

[75] Inventors: Brian S. Bennett, Hertfordshire; David Smith, Kent, both of England

[73] Assignee: Clifford & Snell Limited, Surrey, England

[21] Appl. No.: 264,885

[22] Filed: Oct. 31, 1988

[30] Foreign Application Priority Data

Oct. 30, 1987 [GB] United Kingdom ..... 8725512

[51] Int. Cl.[4] ..... B63C 9/22

[52] U.S. Cl. ..... 441/36; 114/367

[58] Field of Search ..... 441/35, 36, 40, 1, 42, 441/80, 83, 88, 89; 114/367, 365

[56] References Cited

U.S. PATENT DOCUMENTS 3,312,902 4/1967 Dean et al. ..... 441/11

4,280,239 7/1981 Brown ..... 441/42

*Primary Examiner*—Joseph F. Peters, Jr.

*Assistant Examiner*—Edwin L. Swinehart

*Attorney, Agent, or Firm*—Wenderoth, Lind & Ponack

[57] ABSTRACT

A marine radio distress beacon is mounted on the casing of an automatic self-inflating life-raft, the casing being encircled by retaining straps which are broken by the self-inflation of the life-raft, and the beacon being mounted by one or more of the retaining straps so as to be released when the straps break.

6 Claims, 2 Drawing Sheets

FLOAT-FREE ARRANGEMENT FOR MARINE RADIO DISTRESS BEACONS

The invention relates to marine radio distress beacons for location of survivors in the event of an accident at sea. It is a requirement that such beacons should be capable of automatic deployment in the event of the sinking of the vessel on which they are carried. Thus, each beacon should be capable of floating and be stowed in a position where it may float free when released. An automatic release mechanism must be provided, possibly a pressure-sensitive device which releases on submersion to a given depth. The invention seeks to provide an improved deployment system for such a beacon.

According to the invention a marine radio distress beacon is mounted on the casing of an automatic self-inflating life-raft, the casing being encircled by retaining straps which are broken by the self-inflation of the life-raft, adn the beacon being mounted by one or more of the retaining straps so as to be released when the straps break. The strap which retains the beacon may be a dedicated strap provided for the purpose or use may be made of the existing life-raft retaining straps.

Mounting the beacon on a life-raft in the "piggy-back" manner described so that it is released by the automatic life-raft mechanism has many advantages. Firstly the life-raft has very considerable bouyancy, which allows it to clear a sinking vessel readily. Secondly, no separate pressure-sensitive release mechanism is required for the beacon. Further, there is no need to allot additional deck or wheel-house space for the beacon. If as is preferred, the beacon is tethered to the life raft, then the beacon cannot float away from the survivors taking to the life raft.

Preferably, it is possible to release the beacon from its mounting manually, so that it may be used by an individual or in conjunction with another life-raft.

In a preferred arrangement the beacon is held in a water-tight two-part housing which is held on the life-raft casing by the retaining strap. The retaining strap serves to hold the two parts of the housing together so that when the strap is broken not only is the housing released from the life-raft casing but also the two parts of the housing come apart to release the beacon. Preferably one part of the housing is weighted so that it will not float, whereas the beacon floats. The aerial of the beacon (which preferably operates in the hundreds of MHz frequency of 406 MHz) may be fixed, or spring-retracted or bent within the housing to extend on release.

The invention will further be described with reference to the accompanying drawings, of which:

Figure 1:
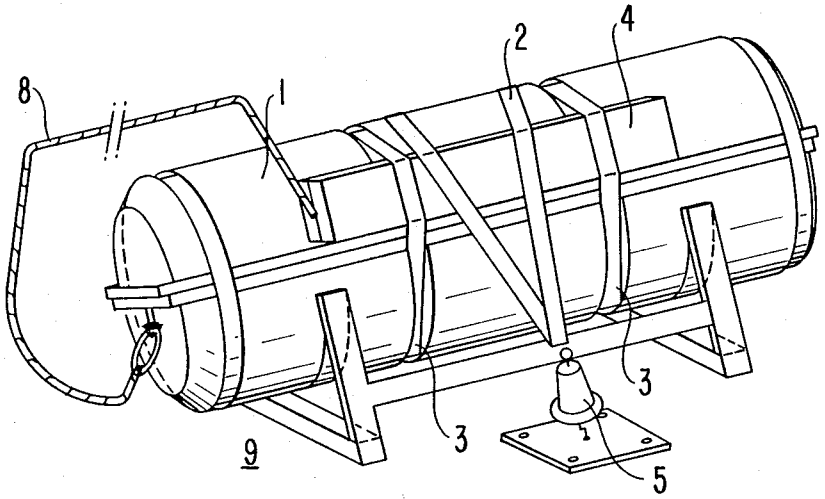
FIG. 1 is a perspective view of a life-raft casing with a distress beacon mounted thereon in accordance with the invention.

Referring to FIG. 1 there is shown a life-raft casing 1 mounted on the deck 9 of a vessel. The casing comprises two halves and is held by a band 2 linked to a hydrostatic release unit 5. A radio distress beacon is mounted within a waterproof housing 4 which is held by retaining straps 3 to the casing.

Figure 2:
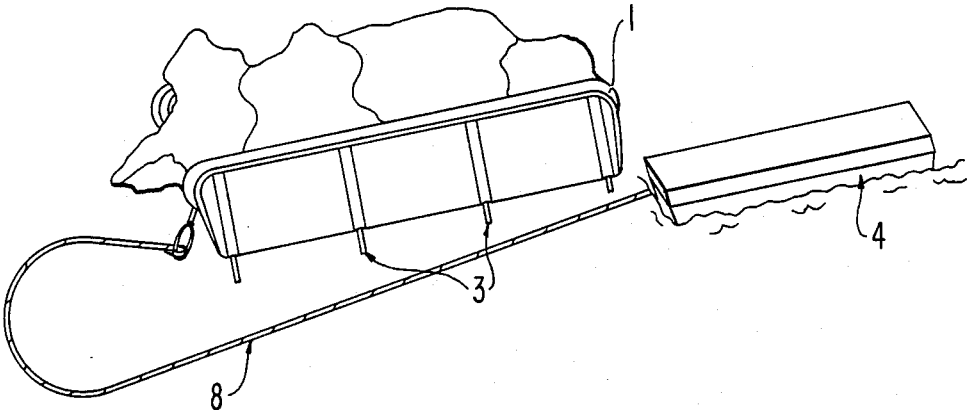
FIG. 2 is a view showing release of the beacon housing and opening of the housing when the retaining strap is broken.

In the event of the vessel sinking, the hydrostatic release unit 5 releases the mounting band at a given depth. The casing and beacon assembly floats to the surface. A supply of pressurised gas inflates the life raft when a line (not shown), tethered to the ship is pulled tight. The inflating life-raft bursts the retaining straps 3 and emerges from the halves of the casing 1. As shown in FIG. 2, the housing 4 is released by breaking of the straps 3. The housing is in two halves of which one is weighted so as not to float. As the weighted half of the housing sinks the beacon itself, which is shown at 7, deploys on the surface. The beacon is tethered to the life-raft by a lanyard 8.

Figure 3:
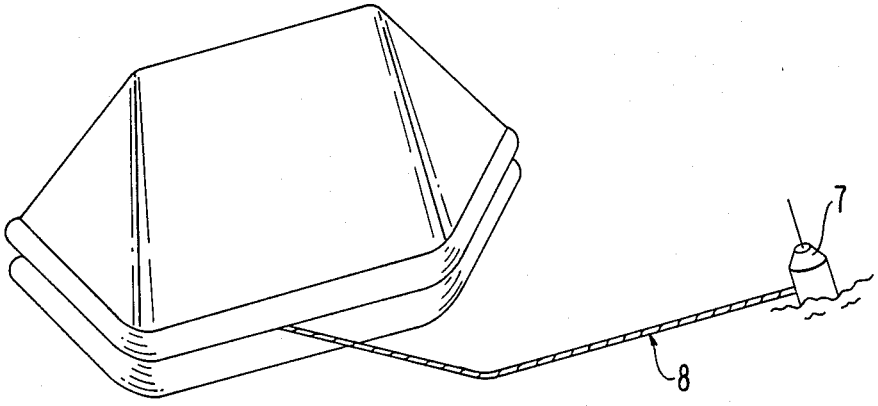
FIG. 3 is a view of the floating beacon.

FIG. 3 shows the beacon floating with the aerial extended. In this position it is capable of automatically transmitting. In the event of abandoning a vessel still afloat the arrangement would deploy the beacon in a similar manner. The mounting straps would be released manually and the casing and beacon assembly would be thrown overboard.

We claim:

1. A marine radio distress beacon in combination with an automatic self-inflating life-raft, the life-raft having a casing and retaining straps encircling the casing, the retaining straps being breakable by force resulting from self-inflation of the life-raft, the distress beacon being mounted on an exterior surface of the casing so as to be retained thereon by at least one of the said retaining straps so as to be released on breakage of the straps.

2. The combination of claim 1 wherein the said at least one retaining strap which retains the beacon is one of a number of straps normally provided for retaining the casing.

3. The combination of claim 1 wherein the said at least one retaining strap which retains the beacon is a dedicated strap specially provided for the purpose and additional to retaining straps normally provided for retaining the casing.

4. The combination of claim 1 wherein said at least one retaining strap is adapted to be manually releasable to thereby release the beacon manually from the casing.

5. The combination of claim 1 wherein the beacon comprises a water-tight two-part housing and the said at least one retaining strap serves to hold the two parts of the housing together so that when the said at least one retaining strap is broken not only is the housing released from the life-raft casing but also the two parts of the housing come apart to release the beacon.

6. The combination of claim 5 wherein one part of the housing is weighted so that it will not float, whereas the beacon within the housing floats.

* * * * *